US005557162A

United States Patent [19]

Han

[11] Patent Number: 5,557,162

[45] Date of Patent: Sep. 17, 1996

[54] COLOR PICTURE TUBE WITH A SHADOW MASK SUPPORT MEMBER

[75] Inventor: Jung-chang Han, Kyunggi-do, Rep. of Korea

[73] Assignee: Samsung Display Devices Co., Ltd., Kyunggi-do, Rep. of Korea

[21] Appl. No.: 374,184

[22] Filed: Jan. 18, 1995

[51] Int. Cl.[6] ..... H01J 29/81

[52] U.S. Cl. ..... 313/402; 313/406; 313/407

[58] Field of Search ..... 313/402, 404, 313/406, 407

[56] References Cited

U.S. PATENT DOCUMENTS

| | | | |
|---|---|---|---|
| 3,803,436 | 4/1974 | Morrell | 313/406 |
| 4,827,180 | 5/1989 | Sone et al. | 313/404 |
| 4,916,357 | 4/1990 | Nakamura et al. | 313/407 |
| 5,347,195 | 9/1994 | Seo | 313/406 |

FOREIGN PATENT DOCUMENTS

| | | | |
|---|---|---|---|
| 61-245445 | 10/1986 | Japan | 313/404 |

*Primary Examiner*—Sandra L. O'Shea
*Assistant Examiner*—Matthew J. Esserman
*Attorney, Agent, or Firm*—Christie, Parker & Hale, LLP

[57] ABSTRACT

The present invention is directed to a color cathode ray tube comprising an evacuated envelope with a tube axis including a face panel having an inside wall with stud pins, a funnel connected to the panel and a neck extending from the funnel; a shadow mask assembly including a shadow mask facing the face panel, and a mask frame for supporting the shadow mask; a plurality of support members for suspending the shadow mask assembly to the stud pins, each of the support members comprising a first arm portion coupled to the study pin, a second arm portion connected to the mask frame and a folded portion connecting the first and second arm portions with each other; and a control member for controlling a deformation of each the support members, the control member connecting the folded portion to the mask frame, whereby the rotation of the shadow mask assembly caused by a deformation of the support member by an irregular inside wall of the face panel or by a thermal expansion of the shadow mask assembly can be prevented.

2 Claims, 3 Drawing Sheets

PRIOR ART

COLOR PICTURE TUBE WITH A SHADOW MASK SUPPORT MEMBER

BACKGROUND OF THE INVENTION

1. Field of the Invention

The present invention relates to a color cathode ray tube and, more particularly, to a support member which suspends a shadow mask assembly, which has a shadow mask and a mask frame for supporting the shadow mask, at the diagonal portions of the inside of a face panel of a color cathode ray tube.

2. Background of the Invention

A color cathode ray tube of a shadow mask type has electron beams emitted from an electron gun which pass through apertures of the shadow mask to land on R, G and B pixels, respectively, on a phosphor layer.

However, part of the electron beams pass through the apertures of the shadow mask and the rest strike the inner surface of the shadow mask so as to heat it. As a result, the shadow mask is thermally expanded and domes out, such that the position of the apertures is changed against the electron beam. Thus, a demand for compensating the change is proposed.

As a conventional method of solving the doming of the shadow mask, support members called corner springs are interposed between stud pins installed at a predetermined position of the inside of a panel and a mask frame for supporting the shadow mask so as to compensate the changed position of the apertures caused by the doming.

The corner springs are installed at the center portions of the panel sides or at the corners of the long and short sides of the frame. A structure having corner spring installed on the corners of the frame has the advantage of suppressing the free vibrations of the frame.

For example, U.S. Pat. No. 4,827,180, particularly FIG. 3, discloses a shadow mask assembly suspended by four support members on the four corners of the substantially rectangular panel. Each support member has a V-shape constructor and includes a first arm portion, a second arm portion and a folded portion connecting the first and second arm portions with each other.

This shadow mask assembly has several advantages. First, when the tube operates and the temperature of the mask frame is increased, the first and second arm portions are both deformed to a flat plate, and this deformation absorbs the expansion of the mask frame. Consequently, the mask frame does not move toward the phosphor layer. Therefore, the position of the apertures does not change, and the electron beam correctly lands on the aimed phosphor pixel. Second, since the substantially rectangular mask frame is suspended by its four corners, the influence of deformations of the mask frame is smaller in comparison with a shadow mask assembly in which the mask frame is suspended by the center portions of the panel side. This can reduce the electron beam's tendency to misland on phosphor elements.

The attaching and detaching of the shadow mask assembly which is repeated many times is required to form the phosphor layer during the manufacturing process of the color cathode ray tube. At this point, in the case where the unevenness of the inside wall of the panel is severe, as shown in FIG. 5, the attachment section 511 of the first arm portion 51 is forced by force P and this force P acts as twist force P' to deform the first arm portion 51. In this case, if the calcination process for thermally removing all alien substances of each phosphor layer and panel is initiated, the support member 50 having a self-elastic force is thermally changed and tends to return to its original configuration, whereby folded portion 54 connecting the first and second arm portions with each other is forced by twisting force P". Accordingly, the mask frame suspended on the securing section of the second arm portion of the support member rotates by the deformation of the second arm portion. As a result, the initial position setting value of the shadow mask is changed, thereby deteriorating the purity of the color cathode ray tube.

BRIEF DESCRIPTION OF THE PRESENT INVENTION

Therefore, the present invention has been made in an effort to solve the above-described problems.

It is an object of the invention to provide a color cathode ray tube which can prevent the initial setting value of the shadow mask from changing, thereby improving purity and howling characteristics of a color cathode ray tube.

To achieve the above object, the present invention provides a color cathode ray tube comprising: an evacuated envelope with a tube axis including a face panel having an inside wall with stud pins, a funnel connected to the panel and a neck extending from the funnel; a shadow mask assembly including a shadow mask facing the face panel, and a mask frame for supporting the shadow mask; a plurality of support members for suspending the shadow mask assembly to the stud pins each of the support members comprising a first arm portion coupled to the stud pin, a second arm portion connected to the mask frame and a folded portion connecting the first and second arm portions with each other; and a control member for connecting the folded portion of each of the support members to the mask frame, said control member having means for reducing a rotation of the shadow mask assembly caused by a deformation of each of the support members by an irregular inside wall of the face panel or a thermal expansion of the shadow mask assembly.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENT

Figure 1:
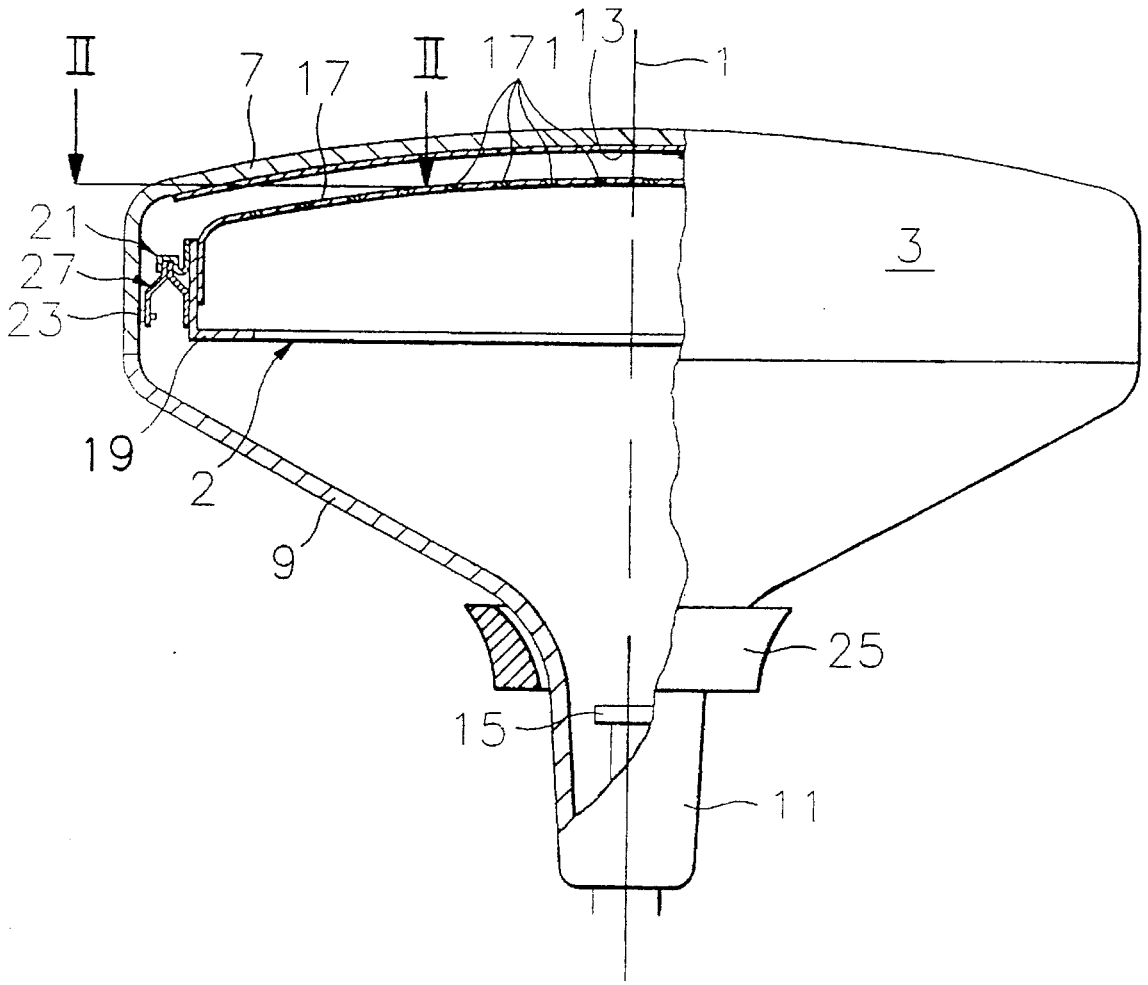
FIG. 1 is a partial cut-away sectional view of a color cathode ray tube where a shadow mask assembly according to a preferred embodiment of the present invention is adapted.

A preferred embodiment of the present invention will now be described in detail with reference to the accompanying drawings. Referring now to the drawings, wherein like reference numerals designate identical or corresponding parts throughout the several views.

Figure 2:
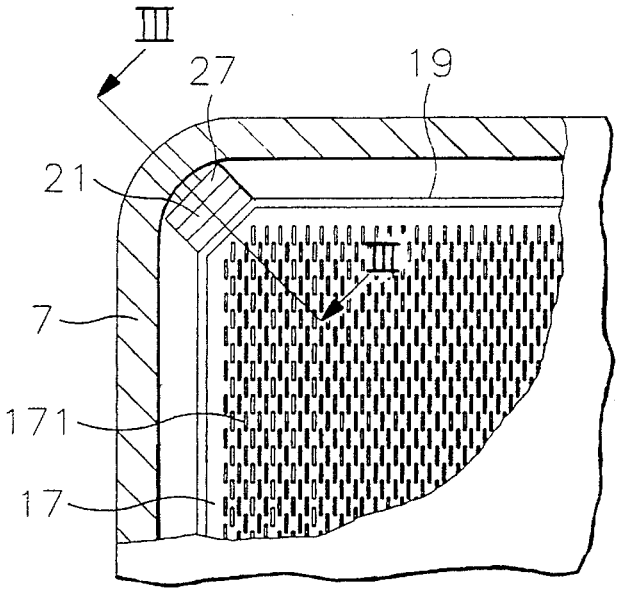
FIG. 2 is a sectional plan view taken along line II—II of FIG. 1.

Referring to FIGS. 1 and 2, a colour cathode ray tube 3 having a tube axis 1 comprises a rectangular shaped panel 7, a funnel 9 connected and sealed to panel 7 and a neck 11 extending from funnel 9, the tube axis 1 passing through the center thereof. On the inner surface of the panel 7, there is deposited a phosphor layer 13 containing phosphor pixels that respectively emit light of red R, green G and blue B. An electron gun 15 is mounted within the neck 11. Gun 15 generates three electron beams aligned along the horizontal axis of panel 7 and corresponding to respective R, G and B pixels.

A shadow mask assembly 2 comprises a rectangular shaped shadow mask 17, a mask frame 19 supporting the shadow mask 17 and a support member called corner spring 27. Shadow mask 17 is rigidly supported by mask frame 19 at a position opposite to phosphor layer 13 so that the tube axis 1 perpendicularly passes therethrough. The shadow mask 17 is provided with a large number of apertures 171. The mask frame 19 is engaged through the corner springs 27 with stud pins 23 implanted in the inner sidewall of the panel 7 at four corners facing diagonally to be supported by the inside panel 7.

Three in-line arranged electron beams generated by gun 15 are deflected by a deflection apparatus 25 outside the funnel 9 so as to scan a rectangular area corresponding to the rectangular panel 7, and to land on the phosphor layer after passing through the apertures 171 of the shadow mask 17. The shadow mask 17 performs color selection so that color picture images can be reproduced.

The shadow mask assembly further comprises a corner spring control member 21, which will be described hereinafter, for preventing the corner spring. 27 from being deformed by thermal change.

Figure 3:
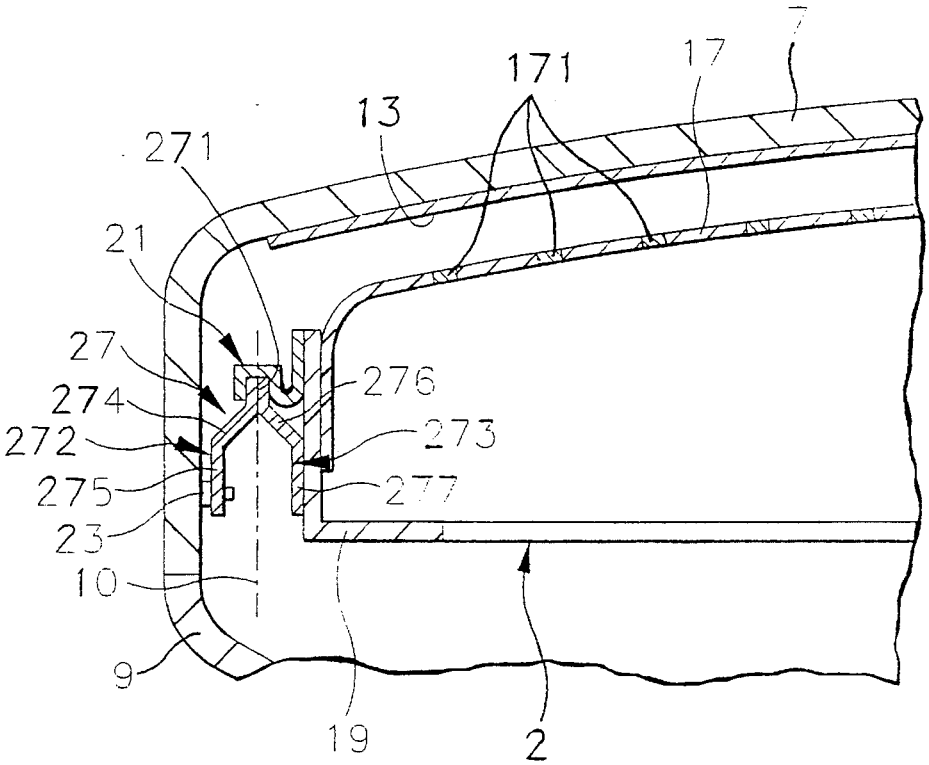
FIG. 3 is a sectional view taken along line III—III of FIG. 2.

The shadow mask assembly 2 will be described in detail with reference to FIG. 3. Corner spring 27 comprises a folded portion 271, a first arm portion 272 and a second arm portion 273, both arm portions connected with each other by folded portion 271. The first arm portion 272 comprises a connection section 274 and an attachment section 275 extending from connection section 274, having an inclination with respect to a line 10 parallel with tube axis 1. Attachment section 275 has a hole 276 engaged with stud pin 23. Second arm portion 273 comprises an angled section 276 having an inclination with respect to the tube axis parallel line 10 and a securing section 277 extending from angled section 276. Securing section 277 is fixed by welding to the sidewall of mask frame 19. First and second arm portions 272 and 273 are welded at folded portion 271, so as to form a substantially V-shaped cross section as viewed along the tube axis 1. Folded portion 271 is positioned at a substantially halfway point between the sidewall of mask frame 19 and stud pin 23 so as to extend away from the side wall.

In the shadow mask assembly supporting member 27 as described above, a corner spring control member 21 for preventing the corner spring from being deformed is further provided. The control member 21 additionally connects folded portion 271 to mask frame 19 so that the rotation of corner spring 27 caused by the irregular inside wall of face panel 7 can be prevented.

Figure 4:
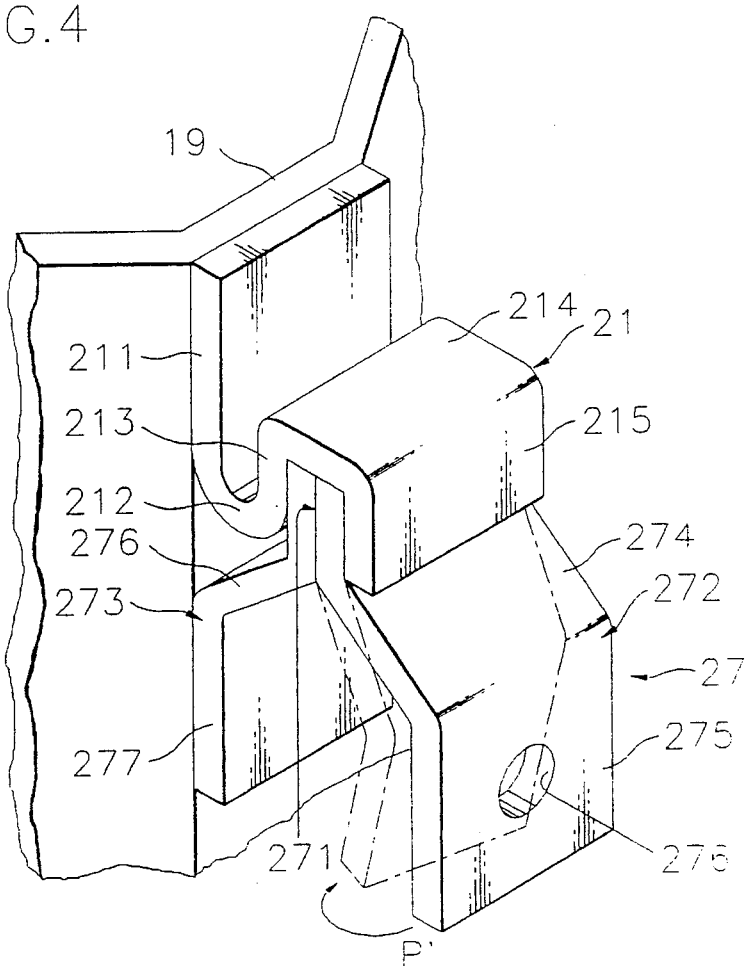
FIG. 4 is an enlarged perspective view of a mask frame supporting part according to a preferred embodiment of the present invention.
Figure 5:
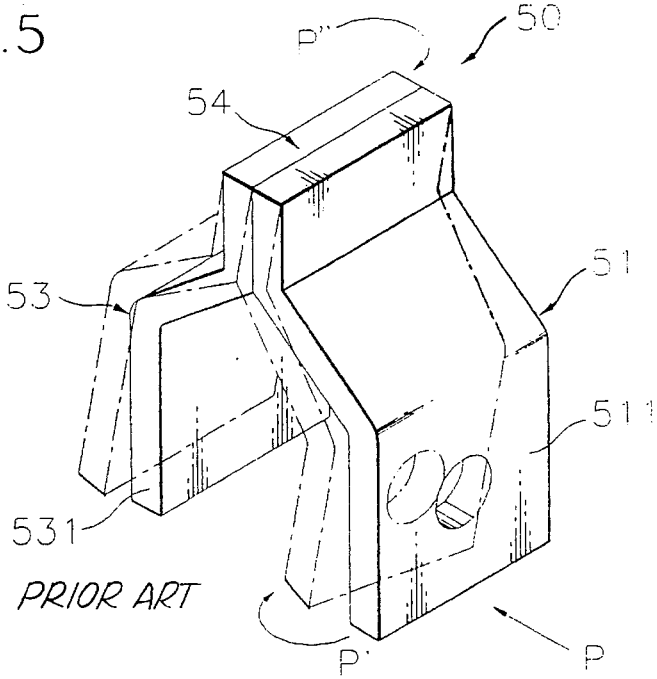
FIG. 5 is a perspective view illustrating the deformation of a conventional support member.

Structure and operation of corner spring control member 21 will be described hereinafter with reference to FIG. 4.

Corner spring control member 21 comprises a fastening section 211 supported and welded to the mask frame 19 above corner spring 27, an arcuate elastic section 212 extending from fastening section 211 a first corner spring support section 213 upwardly extending from elastic section 212 and contacting a frame-side wall of folded portion 271, a connecting section 214 extending and vertically bent from the first corner spring support section 213, and a second corner spring support section 215 extending from connecting section 214 and contacting a panel side wall of folded section 271. That is, folded portion 271 of the corner spring is fitted between the first support section 213 and the second support section 215.

According to the corner spring control member 21 as described above, even if first arm portion 272 receives force P' to thereby be deformed, since folded portion 271 connecting first arm portion 272 with second arm portion 273 is fitted between the first and second corner spring support sections 213 and 215, deformation of folded portion 271 can be restricted by the first and second support sections 213 and 215 and absorbed by the elastic-sections 212. As a result, twisting force P' applied to first arm portion 272 is not transmitted to second arm portion 273 and thereby does not have an effect on second arm portion 273. That is, as shown in FIG. 4, even if the first arm portion 272 is deformed by an outer force, the second arm portion 273 is not deformed by the corner spring control member 21.

In other words, even when corner spring 27 is deformed by an outer factor, since the second arm portion 273 having an effect on mask frame 19 is not influenced by the deformation of first arm portion 272, the initial position setting value is not changed.

Although the preferred embodiment of the present invention has been described in detail hereinabove modifications of the basic inventive concepts herein art will still fall within the spirit and scope of the appended claims.

What is claimed is:

1. A color cathode ray tube comprising:

an evacuated envelope with a tube axis including a face panel having an inside wall with stud pins, a funnel connected to the face panel and a neck extending from the funnel;

a shadow mask assembly including a shadow mask facing the face panel, and a mask frame for supporting the shadow mask;

a plurality of support members for suspending the shadow mask assembly to the stud pins, each of the support members comprising a first arm portion coupled to the stud pin, a second arm portion connected to the mask frame and a folded portion connecting the first and second arm portions with each other; and a control member for connecting the folded portion of one of the support members to the mask frame, said control member having a fastening section supported and welded to the mask frame above the one support member, and an arcuate elastic section extending from the fastening section, a first corner spring support section upwardly extending from the elastic section and contacting a side wall of the folded portion, a connecting section extending perpendiculenly from the first corner spring support section, and a second corner spring support section downwardly extending from the connecting section and contacting an opposite side wall of the folded portion.

2. The color cathode ray tube according to claim 1 wherein the first arm portion comprises a connection section extending from the folded portion toward the panel at a predetermined angle with respect to a line parallel with the tube axis and an attachment section extending from the connection section in parallel with the line, and wherein the second arm portion of each support member comprises an angled section extending from the folded portion toward the mask frame at a predetermined angle with respect to the line and a securing section extending from the angled section in parallel with the line.

* * * * *